United States Patent [19]

Postlethwaite

[11] 3,940,890

[45] Mar. 2, 1976

[54] MODULAR ACCOMMODATION SYSTEM

[75] Inventor: William F. Postlethwaite, New York, N.Y.

[73] Assignee: Skycell Corporation, North Marshfield, Mass.

[22] Filed: Sept. 24, 1974

[21] Appl. No.: 508,909

[52] U.S. Cl. ..... 52/79; 52/263
[51] Int. Cl.[2] ..... E04H 1/12
[58] Field of Search ..... 52/236, 263, 79, 73, 237, 52/82, 65

[56] References Cited

UNITED STATES PATENTS

| | | | |
|---|---|---|---|
| 2,154,142 | 4/1939 | Whelan | 52/79 |
| 3,500,595 | 3/1970 | Bennett | 52/236 |
| 3,526,067 | 9/1970 | Furter | 52/79 |
| 3,529,386 | 9/1970 | Ostendorf | 52/79 |
| 3,690,077 | 9/1972 | Dalgliesh | 52/79 |

FOREIGN PATENTS OR APPLICATIONS

| | | | |
|---|---|---|---|
| 608,401 | 9/1960 | Italy | 52/79 |

OTHER PUBLICATIONS

Architectural Record, Jan. 1934, p. 30.

*Primary Examiner*—John E. Murtagh
*Attorney, Agent, or Firm*—Darby & Darby

[57] ABSTRACT

A system for accommodating people for any of numerous functions, such as housing, schools, offices, hotels, etc., including one or more generally rectangular modules which can be arranged to afford maximum flexibility in both spatial orientation and interior and exterior living space. Each module comprises top and bottom preformed shells which receive the upper and lower edges of vertical wall sections. Each module is supported in a cantilever fashion by a plurality of columns spaced in a predetermined configuration which support the entire structural load of the module so that exterior and interior wall sections can be selectively chosen during fabrication to include windows or doors or as solid, opaque members (or be omitted entirely). Modules can be vertically stacked in a variety of configurations, e.g., displaced at 90° angles to one another by aligning and connecting the columns of a lower module to the corresponding columns in the module immediately below. The displaced vertical stacking arrangement in combination with a multiplicity of possible lateral orientations of the modules provides substantial flexibility in the extent of both interior and exterior living space. The specific techniques for connecting vertically adjacent columns and columns to the modules are also disclosed.

2 Claims, 14 Drawing Figures

MODULAR ACCOMODATION SYSTEM

BACKGROUND OF THE INVENTION

This invention relates generally to modular accommodation systems for housing, schools, offices, etc., and, more particularly, to accommodation systems comprising modules which may be stacked in a variety of different configurations to provide maximum geometrical flexibility and living space.

The drastically increasing rate of population growth over the past few years coupled with a general migration of the population towards urban centers has resulted in an increased need for medium and high density housing at low cost. Currently available conventional housing of this nature has proven to be not entirely satisfactory to meet these needs for several reasons. For example, conventional housing, such as high-rise apartment houses, provide insufficient, if any, access to private outdoor living space due to their rigidized geometry. Additionally, although it is highly desirable both physically and psychologically for the interior of an apartment to have some exposure to sunlight through a window or by other means during the day, the linear nature of conventional high-rise apartments often does not permit such exposure for a substantial number of apartments. Nor has it been feasible to provide sufficient land surrounding conventional high-density dwelling structures for use as public amenity areas, such as playgrounds, parks, etc. Further, the construction of conventional high-rise type dwellings is dependent to an extent upon external factors such as weather which often delay construction thereby causing deleterious changes in construction schedules which add to the already high cost of construction.

There have been several attempts to design modular housing systems to meet medium and high density needs which seek to overcome one or more of these problems. However, such systems have not proven entirely adequate. In the main, due to the desire to provide modules amenable to mass production techniques, they offer little more geometrical flexibility with regard to the orientation of living area than do the high-rise type dwellings discussed above. They provide little additional private exterior living space relative to the conventional housing they seek to replace and, in fact, often result in a decrease in environmental quality. In general, it may be said that aside from possible improvements in the time and cost of construction, little progress has been made in alleviating the problems existing in the medium and high density housing area, either through conventional means or through modular housing systems.

SUMMARY OF THE INVENTION

Accordingly, one object of this invention is to provide a new and improved modular accommodation, system.

Another object is the provision of a new and improved modular accommodation system which provides maximum non-linear geometrical flexibility with respect to the orientation of individual dwellings while maintaining individual privacy.

Still another object is to provide a new and improved modular accommodation system wherein maximum flexibility is provided with respect to the provision of windows, terraces, and other means of communication with the external environment.

A further object of this invention is to provide a new and improved modular accommodation system comprising modules which combine particular suitability to mass production techniques and still provide multiple possibilities for geometrical arrangements of the modules.

A still further object is the provision of a new and improved modular accommodation system wherein the walls of each module bear no structural load so that they may be selectively chosen during fabrication to include windows, doors, etc., to provide communication between both adjacent modules or the external environment.

A still further object is the provision of a new and improved modular accommodation system which affords a maximum of public amenity to space surrounding the dwellings.

Another object is the provision of a new and improved accommodation system which is relatively inexpensive to construct and which may be assembled in the factory in a minimum amount of time.

In accordance with a preferred embodiment of this invention, these and other objects are attained by providing a modular accommodation system, each module including a top and bottom shell assembly and vertical wall panels whose upper and lower ends are received along the perimeter of the shell assemblies, all being entirely supported in cantilever fashion by an arrangement of structural columns connected to truss elements nested within the shells. The columns are arranged so that modules may be vertically stacked above one another, either directly or rotated by 90° in one embodiment, by aligning and connecting the lower ends of the upper modules' columns to the upper ends of the lower modules' columns by ferrules, gusset plates or the like.

In another embodiment vertically adjacent modules in a stack may be rotated relative to each other by any desired amount. Since the load of the stacked modules is supported solely by the connected columns, the number of modules which may be stacked is limited only by the strength of these columns while the structure of the individual modules remains independent of the organization of the modules within the stack.

Such structure of the module affords maximum spacial flexibility for the system in addition to particular suitability for production of the modules by mass production techniques. When stacked modules are rotated relative to each other, the roof of a lower module may be used as a terrace by the occupants of an upper module. Since the exterior walls of each module support no load, sections may be omitted completely during fabrication to provide an opening between laterally adjacent modules thereby increasing the living space beyond that available in a single module. Additionally, exterior wall sections containing windows may be used where desired to provide the interior of the module with maximum exposure to sunlight. The rotated stacks further result in an unusually high floor to exterior wall ratio. The lowest module on the stack is preferably supported upon a foundation comprising four structural columns connected to the modules' columns thereby leaving the ground space beneath the stack open preferably for use as playgrounds, etc. By virtue of the nature of rotated stacks made possible by the columnar load-supporting system, a practically limitless number of variations of stacked configurations is possible while the potential of closely grouping the modules into high density configurations is high.

DESCRIPTION OF THE DRAWINGS

A more complete description of the invention and many of the attendant advantages thereof will be readily appreciated by reference to the following detailed description when considered in connection with the accompanying drawings in which.

DESCRIPTION OF THE PREFERRED EMBODIMENTS

Figure 1:
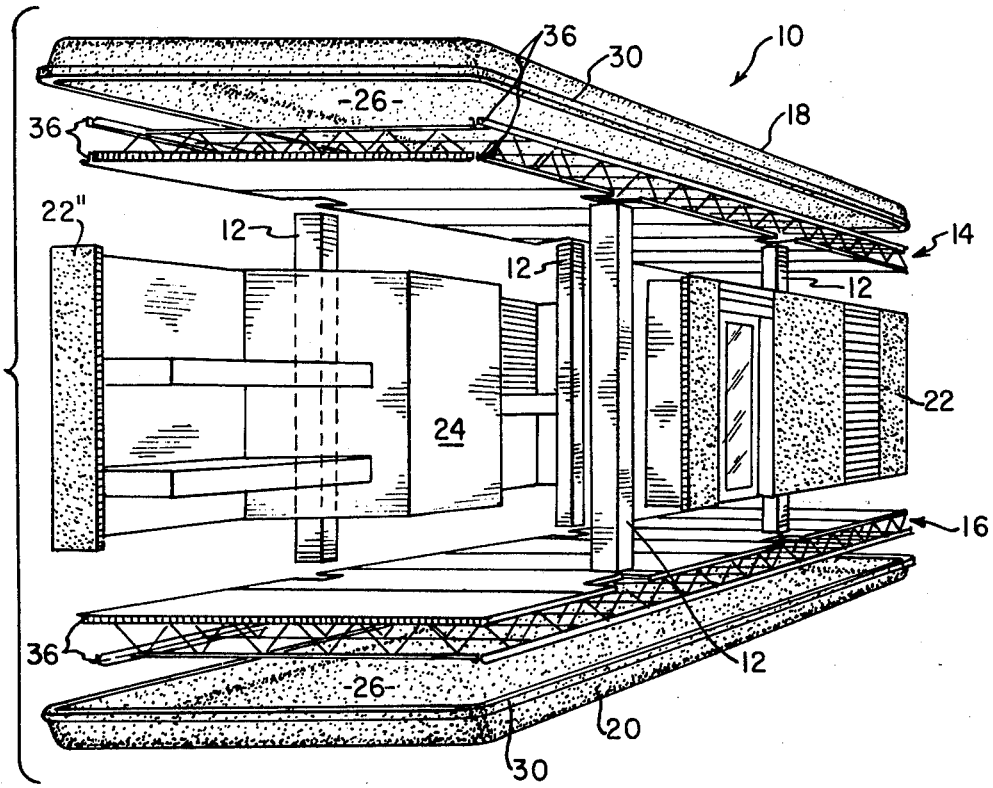
FIG. 1 is an exploded perspective view with portions removed, of one embodiment of module according to the present invention.
Figure 2:
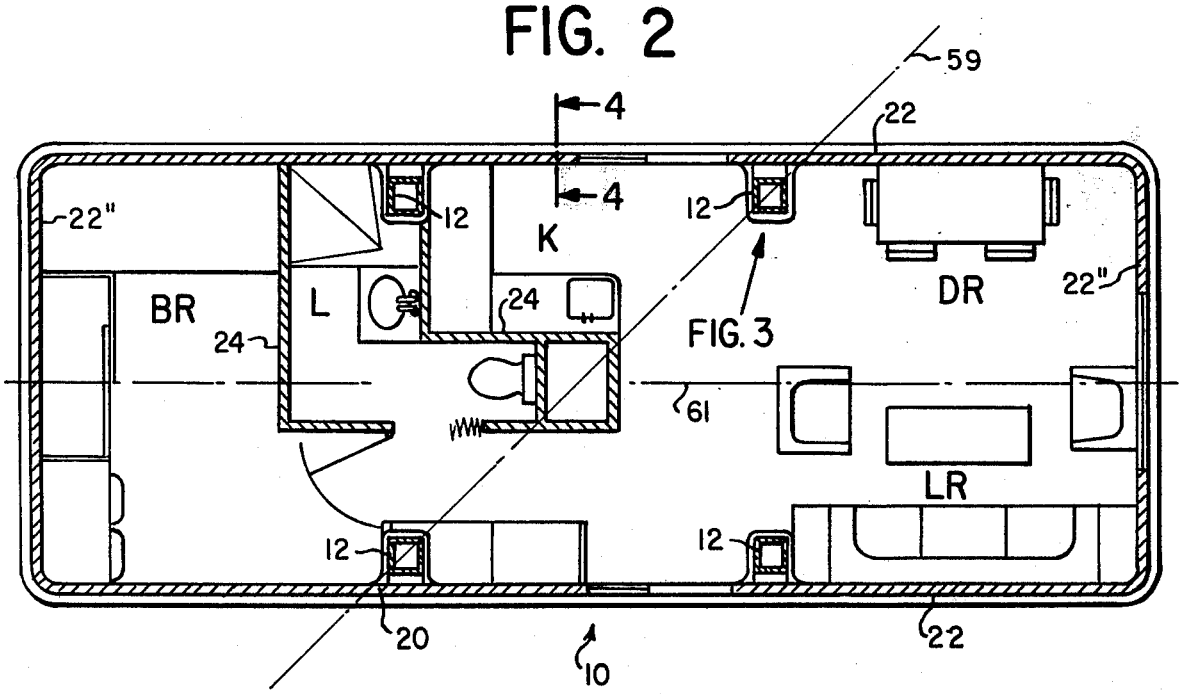
FIG. 2 is a plan view of the module with the upper truss and shell removed.

Referring now to the drawings wherein like reference characters designate identical or corresponding parts throughout the several views, a single, typical module, generally denoted as 10, is illustrated in FIGS. 1 and 2. Generally, four vertical tubular columns 12 are connected near their upper and lower ends to upper and lower trusses 14,16 respectively in a manner to be described in greater detail below. Trusses 14 and 16 nest within and are fixed to top and bottom rectangular, trough-shaped shells 18,20 which define the exterior horizontal boundaries of the module 10. Exterior wall sections 22 are supported at their upper and lower edges within peripheral channels defined between the shell perimeters and respective trusses. The columns 12 support the entire structural load of the module so that the walls 22 are substantially free of stress. The arrangement of the structural columns are of importance in the practice of the invention. In the preferred embodiment, the columns 12 define corners of a hypothetical square (FIG. 2), each column 12 being spaced from an exterior end wall 22'' by a distance equal to approximately one third of the length of the module so that the longitudinal ends of the module are centilevered over the columns. Interior walls or partitions 24 define the usual functional areas within the module such as the kitchen area (K), lavatory area (L), living room (LR), dining area (D) and bedroom (BR). It is understood that although a single module may be utilized alone, it is a feature of this invention to provide a module particularly suitable for construction by mass production techniques which is uniquely capable of inter-communicating with substantially identical modules in a variety of different configurations to achieve maximum geometrical flexibility with respect to living area and maximum density without infringement of private exterior and interior accommodation areas.

Referring now to FIGS. 1–4, the structure of the basic module 10 will be described in greater detail. The top and bottom shell members 18,20 are identically formed, preferably of molded asbestos cement produced from a slurry combining asbestos fiber and Portland cement wherein the asbestos fibers reinforce the cement and impart exceptional strength characteristics to the material. Each shell member is substantially trough-shaped having a planar, horizontal surface 26 with diverging integral side walls 28, the free edges of which terminate in a continuous inwardly facing U-shaped lip 30. Although each shell is preferably formed as a unitary structure, alternatively, the shell may be formed in sections in which case they may be fastened together by the longitudinally extending joists of the truss, the seams being caulked to provide weather proofing. Further, other material may be used to form the module shells such as pre-cast concrete. However, materials such as this are substantially heavier than the preferred material and, accordingly, are not as desirable as asbestos cement.

Upper and lower trusses 14,16 are also preferably identically constructed. The bottom truss is designed to support loads normally occurring in a residential dwelling while the upper truss is identically formed merely for the sake of uniform manufacturing procedures. In the preferred embodiment, each truss comprises a plurality of vertically spaced pairs of chords 32 extending transversely to the shells, each chord comprising double angle members. Web members 34 comprising steel bars extend between the double angle members of chords 32 and are connected to them in any conventional manner, such as by welds, rivets or bolts. Identical web members 34' define the longitudinal ends of the trusses, web members 34' being connected to vertically spaced pairs of longitudinally extending joists 36, preferably also formed of double angle members, but of substantially larger size than the angle members of chords 32.

Figure 3:
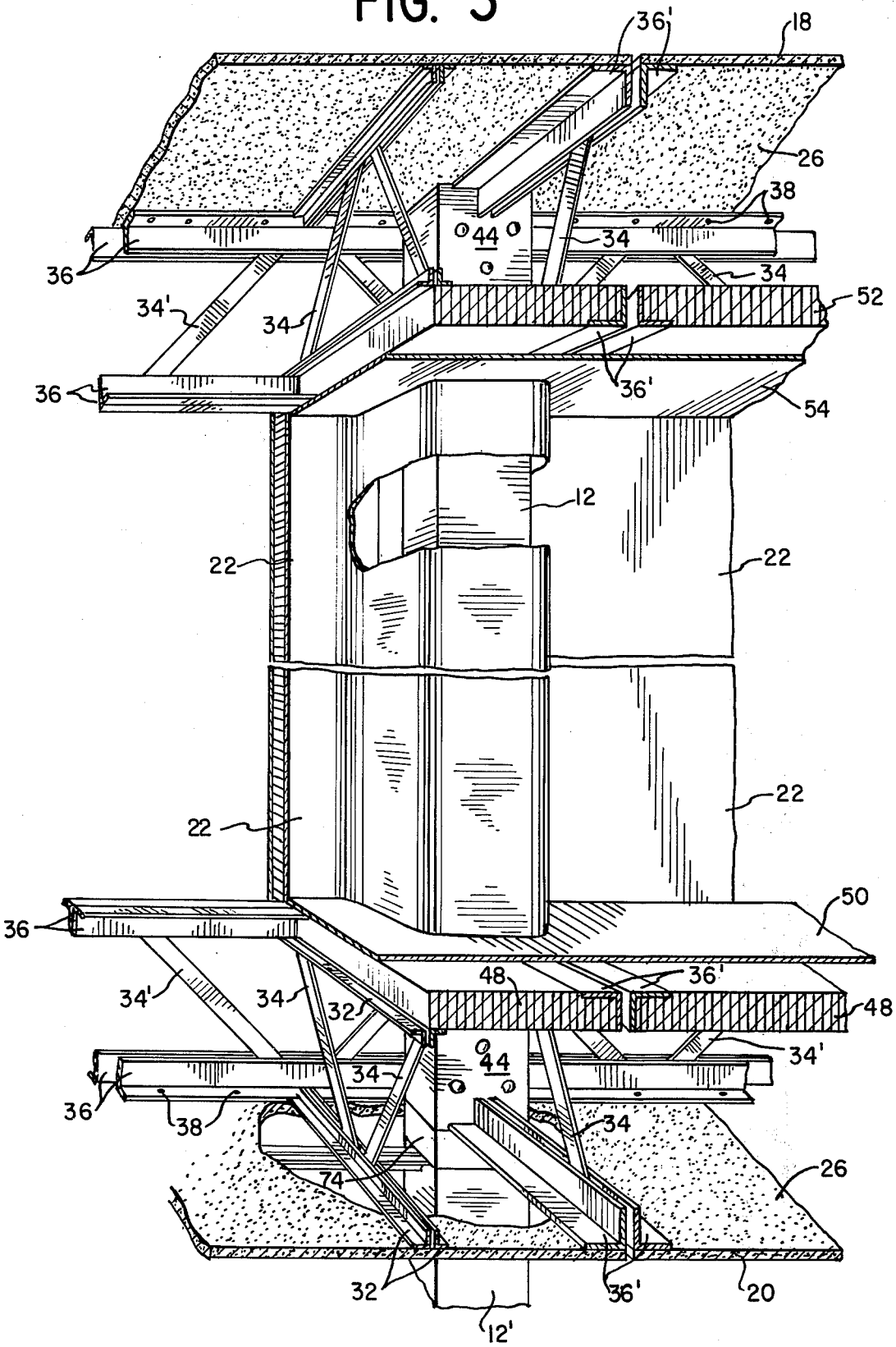
FIG. 3 is a perspective view with portions removed of the interior of a module in the direction of the arrow in FIG. 2.
Figure 4:
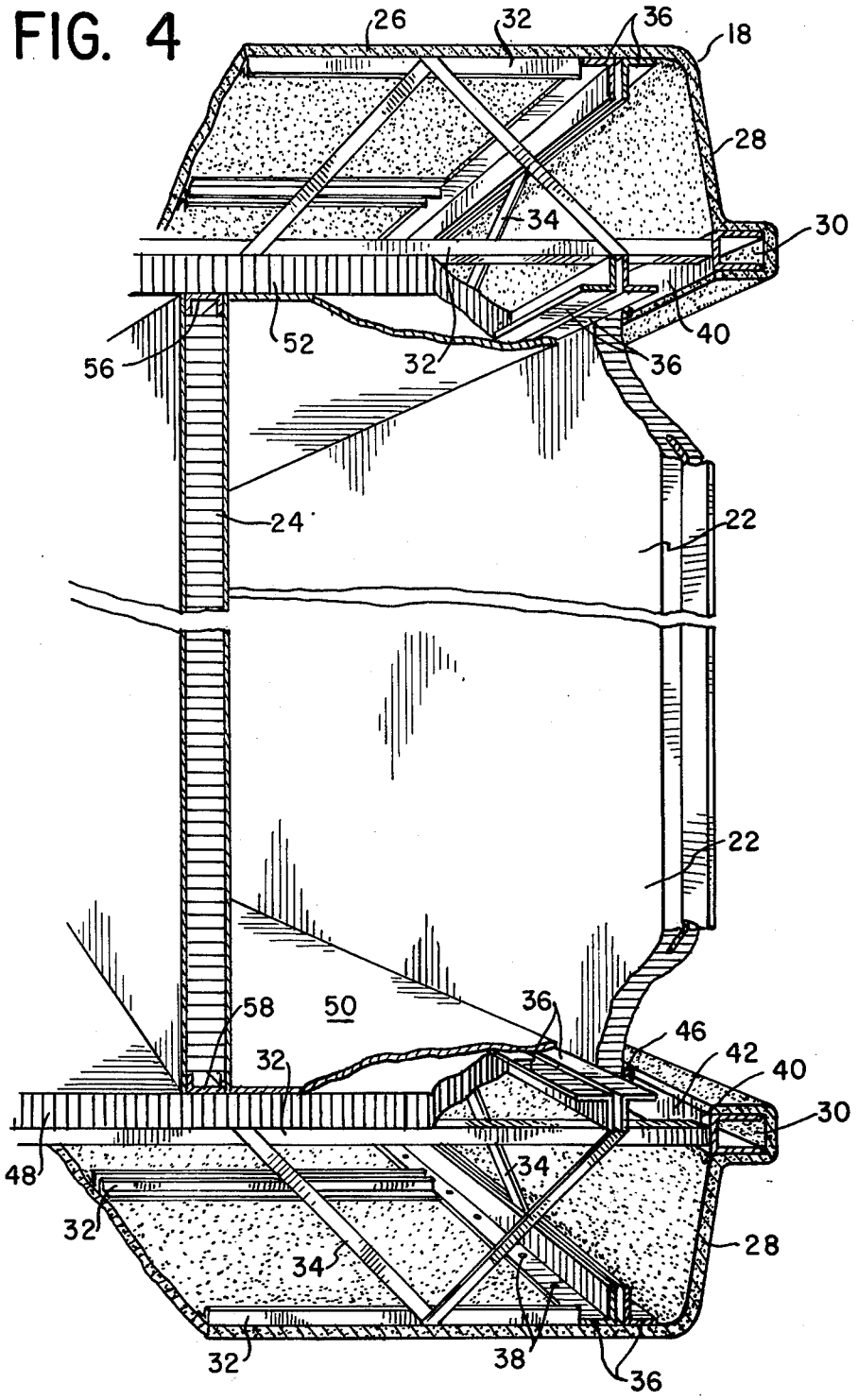
FIG. 4 is a perspective view with portions removed of the interior of a module in the direction of the arrows in FIG. 2.

Still referring to FIGS. 3 and 4, the truss is located within its respective shell, and the primary longitudinal joists 36 which are flush with the inner surface of the horizontal shell surface 26 are fastened thereto by conventional means such as by fastener inserts 38. Further, as seen in FIG. 4, the ends of the outer transverse chords 32 are connected as by welding to the web of a channel member 40 previously located within the lip 30. The outer primary longitudinal joists 36 together with the web of channel member 40 defines a peripheral channel 42 within which the upper and lower edges of the exterior wall sections 22 are located as described below.

The columns 12 which are preferably formed of tubular structural steel are connected to the upper and lower trusses via transverse primary joists 36' (FIG. 3) which extend parallel to chords 32 at those positions which transversely align with columns 12. These transverse primary joists 36' are fastened to the columns by brackets 44 which are bolted to the columns. Thus, it can be seen that the weight of the shell members 18,20 is transmitted via joists 36′ to the columns 12. It is emphasized that regardless of where a module is located within a stacked arrangement, the construction described above remains the same.

The interior walls or partitions 24 and exterior walls 22 are preferably of conventional sandwich construction also employing an asbestos cement material for the outer surfaces and any well known thermal/acoustical insulating material for the core. As seen in FIG. 4, the upper and lower edges of the exterior walls 22 are received within the channels 42 with caulking material 46 applied along the exterior joints. Since all the structural load is supported by columns 12, the exterior walls are essentially stress-free except, of course, for the minimal stresses resulting from their own weight, wind, rain, etc.

Floor panels 48 are mounted over outer chords 32 of the lower truss 16, preferably being retained in position by the horizontal flanges of both the transverse and longitudinal primary joists 36′, 36. A conventional floor surface 50 may then be provided over floor panels 48. In a similar fashion, ceiling panels 52 are provided between the outer transverse chords 32 of the upper truss 14 and the horizontal flanges of the outer primary joists 36, 36′ with a finished surface 54, such as a thin sheet of asbestos cement, being added. The interior partitions or walls 24 which may be formed of the same material as the exterior walls 22 are mounted on U-shaped top and bottom rails 56,58 (FIG. 4) which are preferably removably mounted by any conventional means such as by adhesive, in vertical alignment on the ceiling and floor surfaces respectively.

The single module as described above comprises one embodiment of the basic building block of the accommodation system of the present invention. Although it is possible to build the module 10 to any desired dimensions, it is essential that the module be of rectangular configuration, such as shown in FIG. 2. Modules have been designed in two sizes, namely 12 feet by 30 feet and 20 feet by 40 feet. Provision for all services such as heating, plumbing and air conditioning may be made available in floor and ceiling plenums. It is emphasized that neither the exterior nor the interior walls or partitions bear any structural load. This is important in that windows and doors can be placed in practically any location. As will be seen, this feature enables extreme flexibility not only in the assurance of exposure of the module interior to sunlight, but also in geometrical configuration relative to other modules which are stacked or are parallely situated. The fact that the module preferably does not rest directly on the ground but is elevated by columns embedded in footings whose upper ends are connected to the structural columns 12, provides additional amenity space on the ground level.

Figure 7:
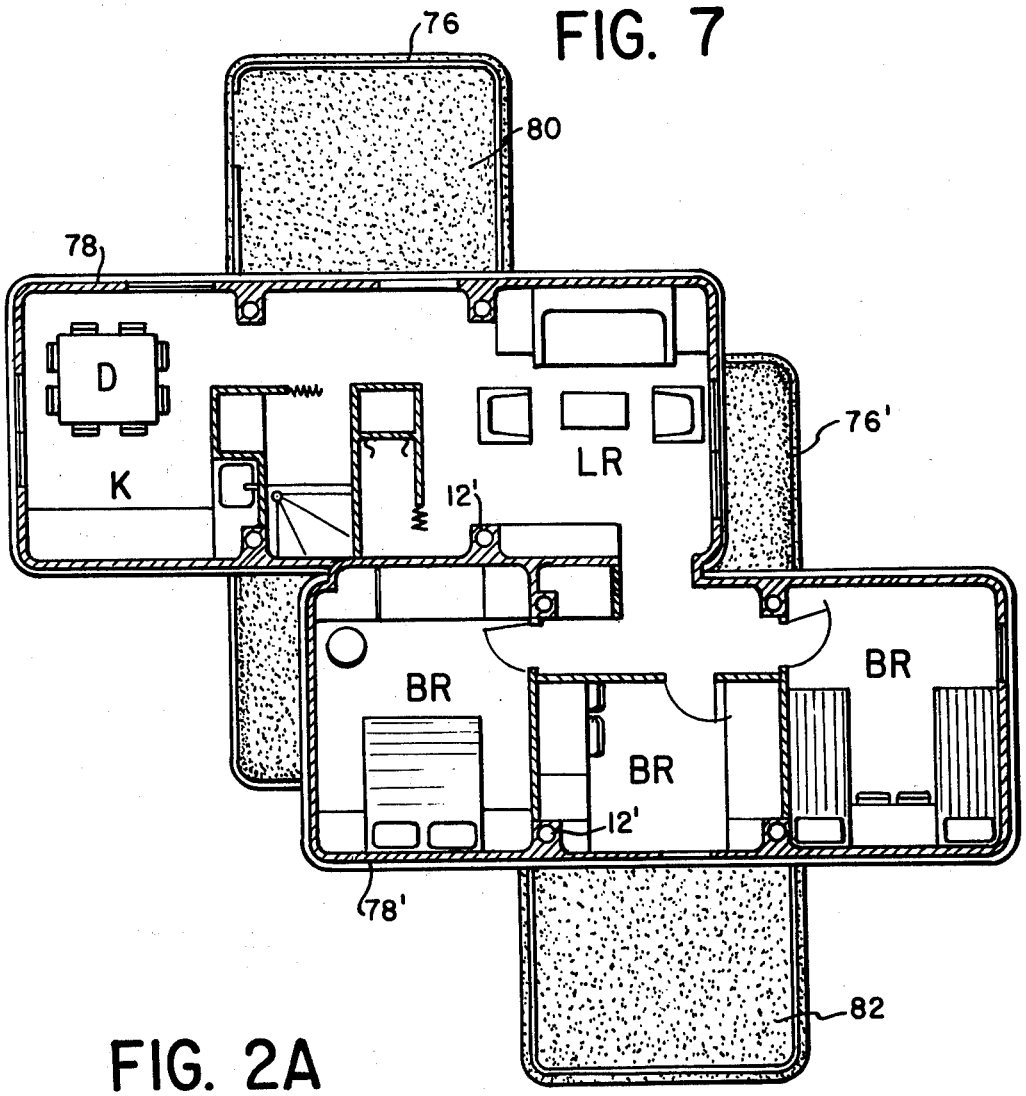
FIG. 7 is a plan view in section of a cluster of modules including vertically stacked and laterally adjacent modules.
Figure 2A:
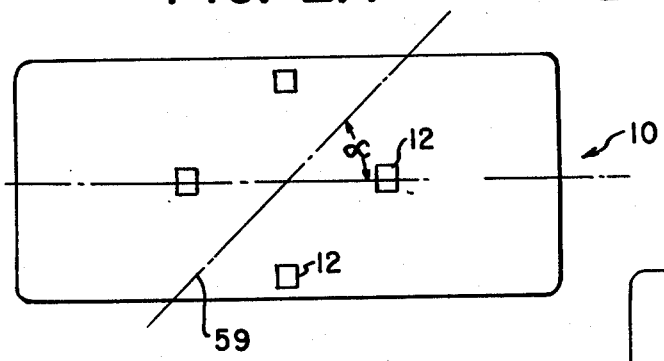
FIGS. 2A and 2B are schematic views of other columnar arrangements which may be used for a module.
Figure 2B:
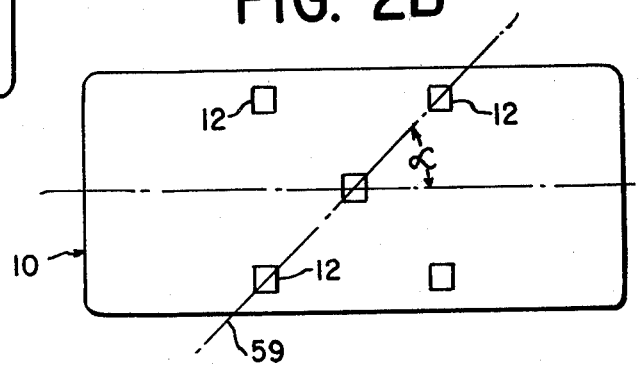
Figure 5:
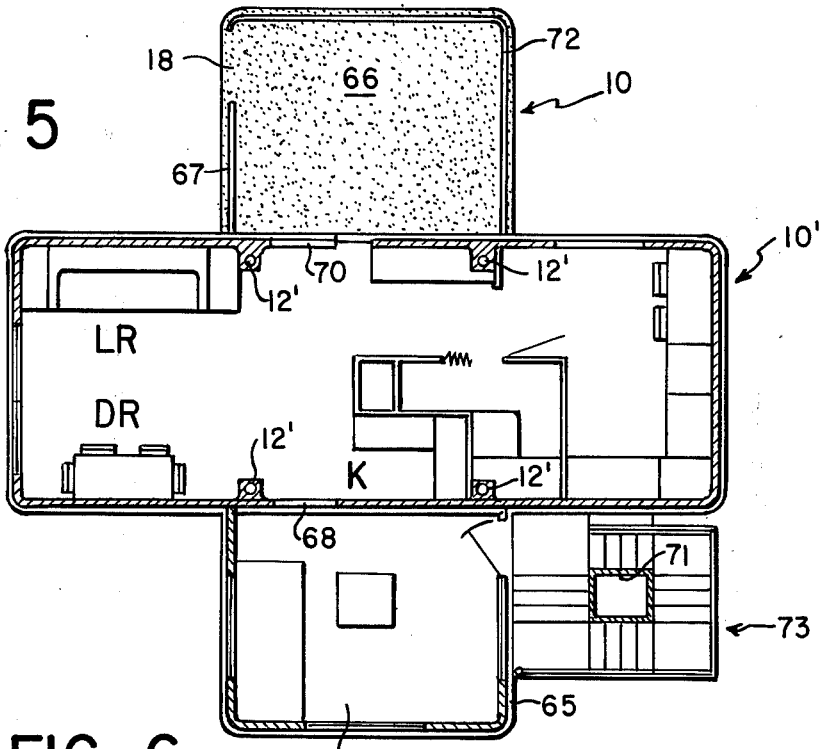
FIG. 5 is a plan view in section of a stacked arrangement of two modules rotated 90° relative to each other.
Figure 6:
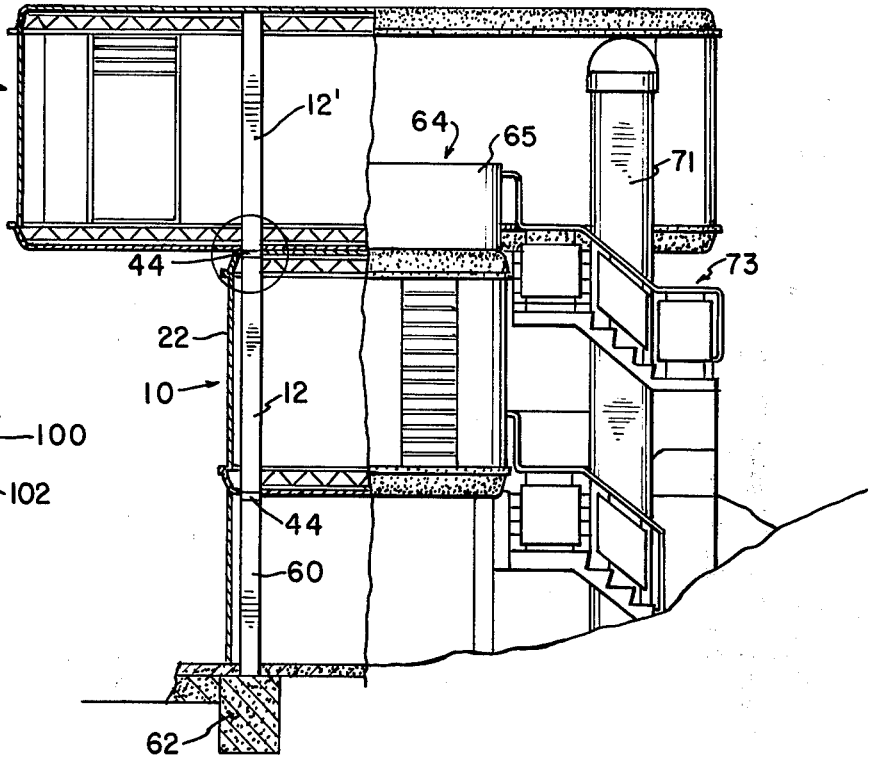
FIG. 6 is a side view in partial section of a stacked arrangement of two modules rotated 90° relative to each other.

Referring to FIGS. 5–7, typical arrangements of a plurality of modules 10 forming the housing system of the present invention will now be described. The unique structural support system of the housing system of the present invention permits two or more modules to be stacked in vertical groups without the need for heavier or structurally different modules at lower levels of multi-story units. Further, the unique columnar arrangement of each module permits stacking of the modules at ninety-degree angles to one another. The columnar arrangement, shown in the preferred embodiment to be of a square configuration, can comprise still other configurations to achieve the desired rotatable stacking capability. Broadly, it is seen that so long as the column arrangement is substantially symmetrical about a vertical plane disposed at a 45 degree angle to the longitudinal axis of the module, the stacked modules may be rotated 90° relative to each other with the vertically adjacent columns aligning with each other. Thus, as seen in FIG. 2, the arrangement of columns 12 is symmetrical about a vertical plane 59 which is disposed at a 45° angle to the longitudinal axis 61 of module 10. FIGS. 2A and 2B illustratively show other possible columnar arrangements. It is noted in each case that the columns are substantially symmetrically located about a plane 59 disposed at approximately a 45° angle $\alpha$ to the longitudinal axis 61 of the modules. It is highly desirable to be able to displace stacked adjacent modules by 90° in order to provide an outdoor living area in the form of a terrace as described below.

Referring to FIGS. 5 and 6, two modules 10 and 10′ are shown in stacked relationship displaced from each other by 90°. Referring to FIG. 6, columns 12 of module 10 are connected to foundation columns 60 which extend from footings 62.

Figure 6A:
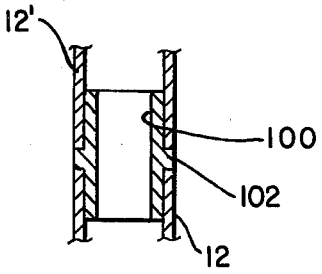
FIG. 6A is a detail view of the column connection in FIG. 6.

FIG. 6A illustrates a preferred design for connecting vertically adjacent columns. A ferrule 100 having a lip 102 is inserted within column 12 and column 12′ located over its upper end. Of course similar ferrules are provided at each column connection. Alternatively, other conventional column connectors may be utilized, such as plates riveted or welded transversely to the mutual column ends and then bolted together. The entire weight of module 10 is transmitted through columns 12 and 60 and thus no load is applied to the walls 22 of module 10. The space beneath module 10 defined between columns 60 may be enclosed or left open as desired to provide a maximum of available public area for walkways, playgrounds, etc. Columns 12′ support module 10′ and are connected at their lower end to the upper ends of columns 12. Columns 12′ similarly to column 12 of module 10, support the entire weight of module 10′. As seen, module 10′ is rotated ninety degrees relative to module 10, and due to the configuration of columns 12′ as described above, these columns align with columns 12 of module 10. Thus, the weight of module 10′ which is carried by columns 12′ is transmitted through columns 12 to columns 60. Thus, the weight of module 10′ (and any other modules which may be stacked above it) is transmitted through the columns only.

Still referring to FIG. 5, 90° displacement of module 10′ relative to module 10 inherently provides the former with external terraces 64 and 66 comprising the upper surface of the top shell member 18 of module 10. In the particular arrangement of modules illustrated in FIG. 5, terrace 64 is enclosed by conventional preformed translucent plastic screens 65, while terrace 66 is left open with railings 67 provided about its perimeter. Wall sections containing doorways 68 and 70 which provide access to terraces 64,66 are provided in lieu of the solid exterior wall sections which would otherwise be used. Since the walls of module 10′ support no structural load, the doorways may be situated in any convenient position by merely removing a wall section at that location. Thus, it is seen that the unique stackability of the modules provides a maximum of exterior living space. In the particular organization of modules shown, a refuse chute 71 may be provided forming a core for a spiral staircase 73 which services the stacked modules.

Referring now to FIG. 7, a cluster of modules is shown which in this example comprises an arrangement of horizontally or laterally interconnecting modules which are also vertically stacked. An important feature of the housing system of the present invention is that two or more modules may be arranged to increase the living space beyond that contained in a single module. Four modules 76, 76′, 78, 78′ are shown. Two module pairs 76, 78 and 78, 78′ are stacked upon each other as described above relative to FIG. 5. The interiors of modules 78, 78′ are interconnected to form a single dwelling unit by omission during fabrication of the exterior wall sections of each module where these wall portions would otherwise coincide. An interior partition 84 is preferably provided to define functional areas within the aparment.

In practice, where the accommodation system of the present invention is to comprise for example, a housing system, after the construction site is chosen, the spacial requirements of the future inhabitants of the dwellings are derived and the modules designed prior to fabrication to provide suitable intercommunication between laterally adjacent ones. The modules may then be mass produced. Thus, the accommodation system of the present invention provides great flexibility in the amount of living space afforded while maintaining the desirable characteristic of being susceptible to mass production techniques. It is understood that an almost infinite number of arrangements of modules are possible in addition to the ones shown in FIG. 7.

The rectangular shape of the modules in combination with the rotatable stacking feature, i.e., where vertically adjacent modules have their longitudinal axes displaced relative to each other, result in several advantages. The ratio of the length of exterior wall to the area within the module is very large enabling windows to be provided as desired. For example, the bedroom (B) at the right side of module 78′ in FIG. 7 may have windows provided in no less than three walls, if desired. However, if an end of a module 79 were placed adjacent to one of the bedroom walls as shown in phantom of FIG. 7, the contiguous bedroom wall of module 78′ would, of course remain solid. Further, the terrace 82 in the case where a module 79 is used, would still provide a private exterior area. This feature provides the added potential of closely grouping the units into any one of a variety of high density configurations while still maintaining the privacy of interior and exterior living areas.

As mentioned above, it is understood that more than two modules may intercommunicate with each other to provide dwelling units of greater area than that available from a single module. For example, using a 30-foot by 12-foot module as the basic building unit in a housing system, a single module having 360 square feet available may be used as a bachelor studio. A one-bedroom apartment may comprise one and one-half modules yielding 540 square feet. A two or three-bedroom apartment may be formed by combining two modules to yield 720 square feet (as shown in FIG. 7). Similarly, three cells may be combined for a three or four-bedroom apartment yielding 1,080 square feet. This, together with the exterior terraces, provides an unusually flexible system wherein a basic module of relatively uncomplicated construction is utilized. Of course, similar intercommunication is available when the system is utilized for hotels, schools, offices, etc.

Various clusters of modules (one cluster being shown in FIG. 7) may be provided, the geometrical relationships between the clusters depending entirely on the choice of pedestrian circulation arrangements. Modules can be sited a considerable distance apart, in close proximity, or directly adjacent to one another. The clear separation of public walkways from private terraces provides a sense of individuality for occupants of the modular housing system.

Although the modules may be constructed on site, their compact size permits their mass production at an off-site factory with subsequent transport by truck to the construction site. The building materials are inexpensive and since there are relatively few components, the cost of building the module is relatively low. The unique manner of interconnecting the modules substantially reduces construction time. For example, two modules have been vertically stacked and connected in rotated relationship in one hour with the mechanical and electrical work completed and the units sealed in less than one day.

Figure 8:
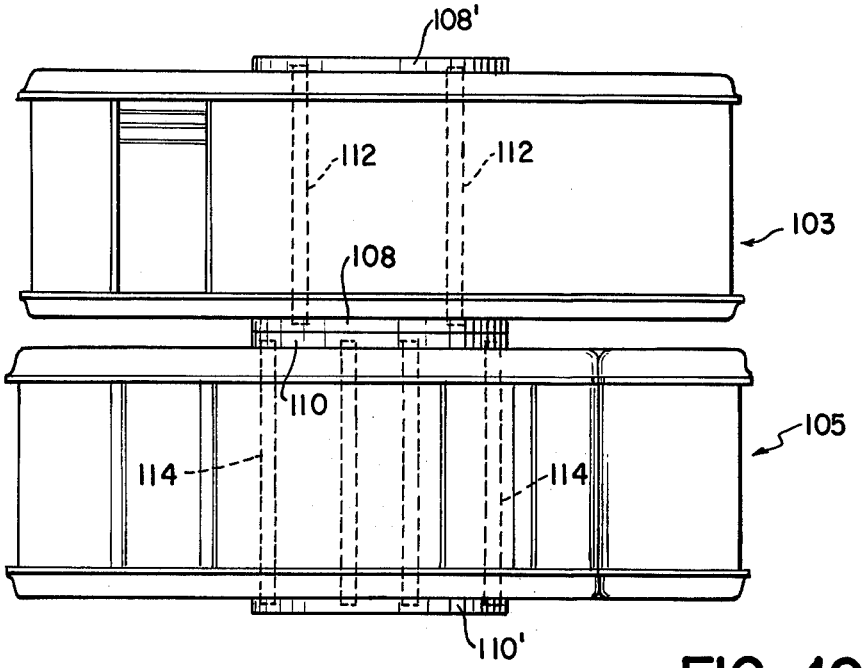
FIG. 8 is a side view in section of a stacked arrangement of two modules according to another embodiment of the present invention.
Figure 9:
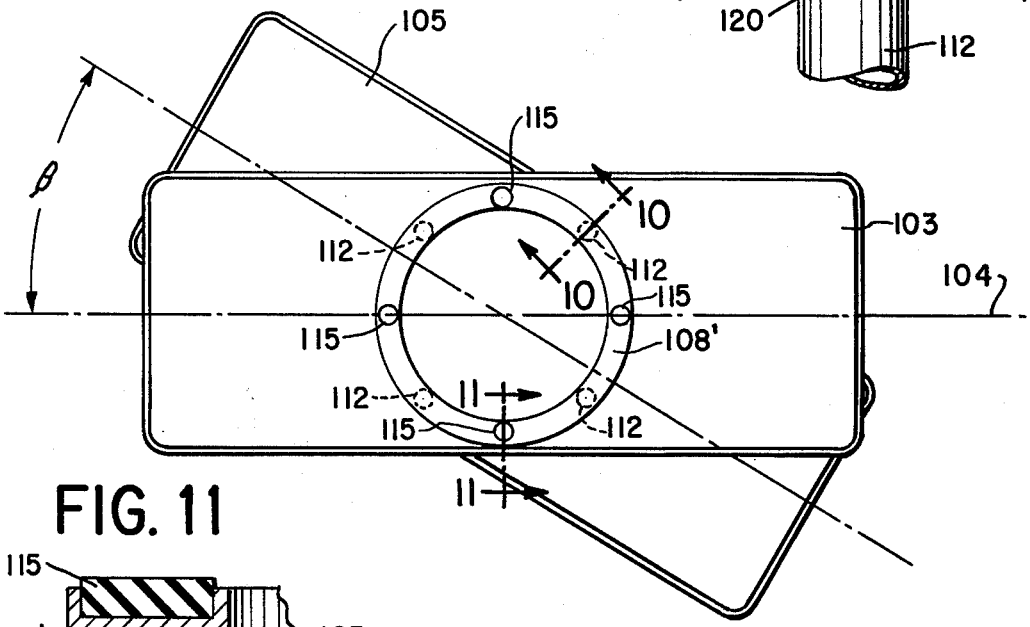
FIG. 9 is a plan view of the modules shown in FIG. 8.

Turning now to FIGS. 8 and 9, another embodiment of the accommodation system of the present invention is illustrated. Briefly, it is a feature of this embodiment that when a plurality of modules are stacked, vertically adjacent ones may be rotated relative to each other with their longitudinal axes forming any desired angle, i.e. rotation is not limited to 90° displacement.

Figure 10:
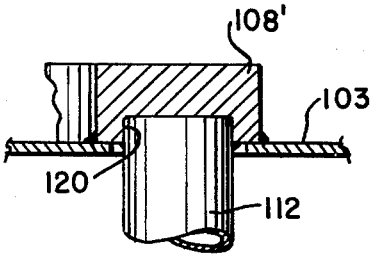
FIG. 10 is a section view taken along line 10—10 of FIG. 9 of a portion of the stacked module arrangement.

As shown in FIGS. 8 and 9, module 103 is stacked on module 105, their respective longitudinal axes 104, 106 forming an angle $\beta$. Essentially, modules 103, 105 are constructed substantially identical to the modules shown in and described relative to FIGS. 1 to 7. However, a pair of ring beams 108, 108′ are rigidly connected to the ends of the columns 112 in module 103 while identical ring beams 110, 110′ are connected to the ends of the columns 114 in module 105. Each ring beam is of an annular configuration and may, for the modular dimensions specified in the description of the first embodiment, have an outer diameter of about 10 feet, and inner diameter of about 8 feet, and a height of about 10 inches. The ring beams, as shown in the drawings, are located on the outer surface of the respective shell members. However, alternatively, they may be provided within the shell member. The vertical column configurations are illustrated as being the same as described above with respect to FIGS. 1 through 7, i.e., a square arrangement. However, other column configurations are possible, for example, a triangular configuration, etc. The only constraint on the particular arrangement of vertical columns being that the column ends must intersect the annular ring beams associated with that particular module. As shown in FIG. 10, the ends of the columns are preferably connected to the ring beams preferably by being received within shallow recesses 120 formed in the ring beam with the subsequent permanent connection of the columns to the ring beams, as by welding. Of course, other conventional methods of attachment may be utilized.

Figure 11:
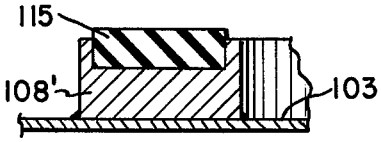
FIG. 11 is a section view taken along line 11—11 of FIG. 9 of a portion of the stacked module arrangement.

During the construction of a typical stack as shown in FIGS. 8 and 9, ring beam 108 is placed directly on the lower ring beam 110. As best shown in FIG. 11, pads 115 of high friction material such as latex may be interposed between the ring beams. The beams are then rigidly joined by bolts or rivits.

It may be seen that by virtue of this construction, 8 vertical adjacent modules may be rotated at any desired angle $\beta$ with respect to each other. Identical advantages are obtained with this construction as are derived from the embodiment of FIGS. 1 to 7, i.e., the vertical columns still support all the structural load facilitating flexibility in varying the exterior construction of the modules. Clusters of modules may be provided with intercommunicating laterally adjacent modules. Terrace areas are still available. Of course, the additional advantage of complete versatility in stacking is obtained here due to the universal possibilities of angles which vertically adjacent modules may define relative to each other.

It should also be noted that other planar members may be substituted for the annular ring beams disclosed, so long as the column ends are rigidly connected to it and the planar members of vertically adjacent modules directly overly one another when the modules are stacked.

Obviously, numerous modifications and variations of the invention may be made in the light of the instant disclosure. It is therefore to be understood that within the scope of the appended claims, the invention may be practiced otherwise than as specifically described herein.

What is claimed is:

1. A module for use in a modular housing system comprising:

upper and lower shell members having identical rectangular, trough-shaped configurations;

upper and lower trusses, each truss including vertically spaced, parallel joists having web members extending therebetween each truss nesting within a respective shell member and fixed therein, a space being formed between the peripheries of the trusses and respective shell members defining peripheral channels;

vertical wall sections extending between the upper and lower shell members, the upper and lower edges of the wall sections being located within the peripheral channels; and an assembly of vertical structural columns each column having its upper and lower end portion connected to the upper and lower trusses respectively so that the entire load of said shell assemblies is transmitted through said columns, the wall sections being essentially free of load, the columns of said column assembly being arranged substantially symmetrically about a vertical plane disposed at a 45° angle relative to the longitudinal axis of said module.

2. A module for use in a modular accommodation system including a plurality of substantially identical ones of such housing modules, comprising:

an upper, horizontally disposed shell assembly;

a plurality of vertical structural columns, each column being connected to and supporting the upper shell assembly;

a lower, horizontally disposed shell assembly spaced from the upper shell assembly and connected to the lower ends of and being supported by said columns;

a first annular shaped ring beam provided in proximity to said upper shell assembly rigidly connected to the upper ends of said columns;

a second annular shaped ring beam provided in proximity to said lower shell assembly rigidly connected to the lower ends of said columns; and exterior vertically disposed wall sections located between the peripheries of the spaced shell assemblies.

* * * * *